US010851613B2

(12) United States Patent
Wroblicky et al.

(10) Patent No.: US 10,851,613 B2
(45) Date of Patent: Dec. 1, 2020

(54) TWO-PART RESTRICTION ELEMENT FOR LARGE-BORE DOWNHOLE ISOLATION TOOL AND METHOD

(71) Applicant: GEODYNAMICS, INC., Millsap, TX (US)

(72) Inventors: Michael Wroblicky, Weatherford, TX (US); Kevin George, Cleburne, TX (US); Dennis Roessler, Fort Worth, TX (US); John Hardesty, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 132 days.

(21) Appl. No.: 16/178,714

(22) Filed: Nov. 2, 2018

(65) Prior Publication Data

US 2019/0136657 A1 May 9, 2019

Related U.S. Application Data

(60) Provisional application No. 62/581,097, filed on Nov. 3, 2017.

(51) Int. Cl.

| | |
|---|---|
| ***E21B 33/12*** | (2006.01) |
| ***E21B 43/14*** | (2006.01) |
| ***E21B 33/128*** | (2006.01) |
| ***E21B 43/12*** | (2006.01) |

(52) U.S. Cl.
CPC ..... *E21B 33/1208* (2013.01); *E21B 33/1285* (2013.01); *E21B 43/12* (2013.01); *E21B 43/14* (2013.01)

(58) Field of Classification Search
CPC .. E21B 33/12; E21B 33/1204; E21B 33/1208; E21B 43/14; E21B 33/1285; E21B 43/12
See application file for complete search history.

(56) References Cited

U.S. PATENT DOCUMENTS

| | | | | |
|---|---|---|---|---|
| 2,249,172 | A * | 7/1941 | Quintrell | E21B 33/12 166/125 |
| 2011/0240295 | A1* | 10/2011 | Porter | E21B 33/12 166/308.1 |
| 2012/0125637 | A1* | 5/2012 | Chenault | E21B 33/134 166/382 |
| 2013/0175053 | A1* | 7/2013 | Madero | E21B 34/14 166/387 |
| 2015/0252643 | A1* | 9/2015 | Mailand | E21B 23/08 166/250.01 |
| 2019/0162044 | A1* | 5/2019 | Dirocco | E21B 33/1294 |

* cited by examiner

*Primary Examiner* — Michael R Wills, III
(74) *Attorney, Agent, or Firm* — Patent Portfolio Builders PLLC

(57) ABSTRACT

A downhole isolation system for sealing a well, the downhole isolation system including a setting tool having an internal chamber; a first restriction element placed within the internal chamber; and a second restriction element placed within the internal chamber, separate from the first restriction element.

27 Claims, 14 Drawing Sheets

TWO-PART RESTRICTION ELEMENT FOR LARGE-BORE DOWNHOLE ISOLATION TOOL AND METHOD

BACKGROUND

Technical Field

Embodiments of the subject matter disclosed herein generally relate to downhole tools related to well perforating and/or fracturing operations, and more specifically, to a two-part restriction element that is capable to seal a large-bore downhole isolation tool.

Discussion of the Background

In the oil and gas field, once a well 100 is drilled to a desired depth H relative to the surface 110, as illustrated in FIG. 1, and the casing 102 protecting the wellbore 104 has been installed and cemented in place, it is time to connect the wellbore 104 to the subterranean formation 106 to extract the oil and/or gas. This process of connecting the wellbore to the subterranean formation may include a step of plugging the well with a plug 112, a step of perforating the casing 102 with a perforating gun assembly 114 such that various channels 116 are formed to connect the subterranean formations to the inside of the casing 102, a step of removing the perforating gun assembly, and a step of fracturing the various channels 116.

Some of these steps require to lower into the well 100 a wireline 118 or equivalent tool, which is electrically and mechanically connected to the perforating gun assembly 114, and to activate the gun assembly and/or a setting tool 120 attached to the perforating gun assembly. Setting tool 120 is configured to hold the plug 112 prior to plugging the well and then to set the plug. FIG. 1 shows the setting tool 120 disconnected from the plug 112, indicating that the plug has been set inside the casing and the setting tool 120 has been disconnected from the plug 112.

FIG. 1 shows the wireline 118, which includes at least one electrical connector, being connected to a control interface 122, located on the ground 110, above the well 100. An operator of the control interface may send electrical signals to the perforating gun assembly and/or setting tool for (1) setting the plug 112 and (2) disconnecting the setting tool from the plug. A fluid 124, (e.g., water, water and sand, fracturing fluid, etc.) may be pumped by a pumping system 126, down the well, for moving the perforating gun assembly and the setting tool to a desired location, e.g., where the plug 112 needs to be deployed, and also for fracturing purposes.

The above operations may be repeated multiple times for perforating and/or fracturing the casing at multiple locations, corresponding to different stages of the well. Note that in this case, multiple plugs 112 and 112' may be used for isolating the respective zones from each other during the perforating phase and/or fracturing phase.

These completion operations may require several plugs run in series or several different plug types run in series. For example, within a given completion and/or production activity, the well may require several hundred plugs depending on the productivity, depths, and geophysics of each well. When a plug is set in a well, it then needs to be plugged so that no fluid passes from an upstream direction to a downstream direction. This operation can be achieved in two ways.

A first way is illustrated in FIG. 2, wherein the setting tool 120 is shown having a reactionary sleeve 222 being in contact with the plug 112. The plug 112 in this embodiment has a mandrel 113 on which various parts (not shown) of the plug are distributed. A mandrel 224 of the setting tool 120 has a piston 225 for compressing the plug 112 against the reactionary sleeve 222, to set up the plug. A restrictive element 210 (a ball in this case) is housed inside the setting tool 120, between the mandrel 224 and the reactionary sleeve 222. Because of the limited space inside the setting tool, and because the mandrel 224 is placed in the middle of the setting tool, the size of the restrictive element 210 is very small, for example, less than half of the diameter of the wellbore. This means that an internal diameter of the mandrel 113 of the plug 112 is bound to be small. After the setting tool 120 sets the plug 112, the setting tool retrieves from the plug and the ball 210 is released from the setting tool. Then, the ball 210 is pumped down to seat in the seat 112A of the plug 112 and to block fluid communication between a section upstream of the plug and a section downstream of the plug.

However, this approach is capped by the maximum ball size that fits inside the setting tool, which is not suitable for a large-bore plug. Note that a large-bore plug has a large inner bore, which is not the case for the plug 112 shown in FIG. 2. The plug 112 has a small bore because of the presence of the mandrel 113 and because of the small diameter of the restrictive element 210.

A second approach to set the plug is to completely remove the setting tool from the well and then to release a large ball for a large-bore plug. However, this approach is time consuming, as the setting tool needs to be removed for each ball dropped from the wellhead. In addition, this approach often requires a large amount of fluid for pumping the ball as the ball typically has to be pumped from the head 122 of the well, and not from a position next to the plug as in the case shown in FIG. 2.

Thus, there is a need for using a large-bore plug with a large restriction element that can be set while the setting tool is inside the well and which uses less fluid for pumping.

SUMMARY

According to an embodiment, there is a downhole isolation system for sealing a well, the downhole isolation system including a setting tool having an internal chamber, a first restriction element placed within the internal chamber, and a second restriction element placed within the internal chamber, separate from the first restriction element.

According to another embodiment, there is a downhole isolation system for sealing a well, the downhole isolation system including a large-bore plug having a seat at an upstream end, a first restriction element configured to seat in the seat of the large-bore plug, and a second restriction element configured to fit inside the first restriction element.

According to still another embodiment, there is a method for plugging a well with a large-bore plug, the method including releasing a first restriction element from within an internal chamber of a setting tool, releasing a second restriction element from within the internal chamber, seating the first restriction element in a corresponding seat of the large-bore plug, and seating the second restriction element within the first restriction element.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a large-bore composite plug. However, the embodiments discussed herein are applicable to a downhole isolation tool or to isolation tools (e.g., plugs) that are not made of composite materials or do not have a large bore.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a large-bore plug is set up with a setting tool that has two additional, detachable components, when compared with a traditional setting tool. The two additional components are a primary restriction element and a secondary restriction element and they form a two-part restriction element. The primary restriction element is configured to be disposed around a mandrel of the setting tool, i.e., the primary restriction element has a body and a full passage that extends through the body and the mandrel of the setting tool extends through the full passage. After the setting tool is withdrawn from the large-bore plug, the primary restriction element is pumped to seat in a corresponding seat formed at one end of the large-bore plug. The secondary restriction element is held inside the setting tool, between the mandrel and a reactionary sleeve. After the primary restriction element is seated to the large-bore plug, the secondary restriction element is seated in a corresponding seat formed inside the passage of the primary restriction element, to seal the entire plug. This novel two-part restriction element is now discussed in more detail with regard to the figures.

Figure 2:
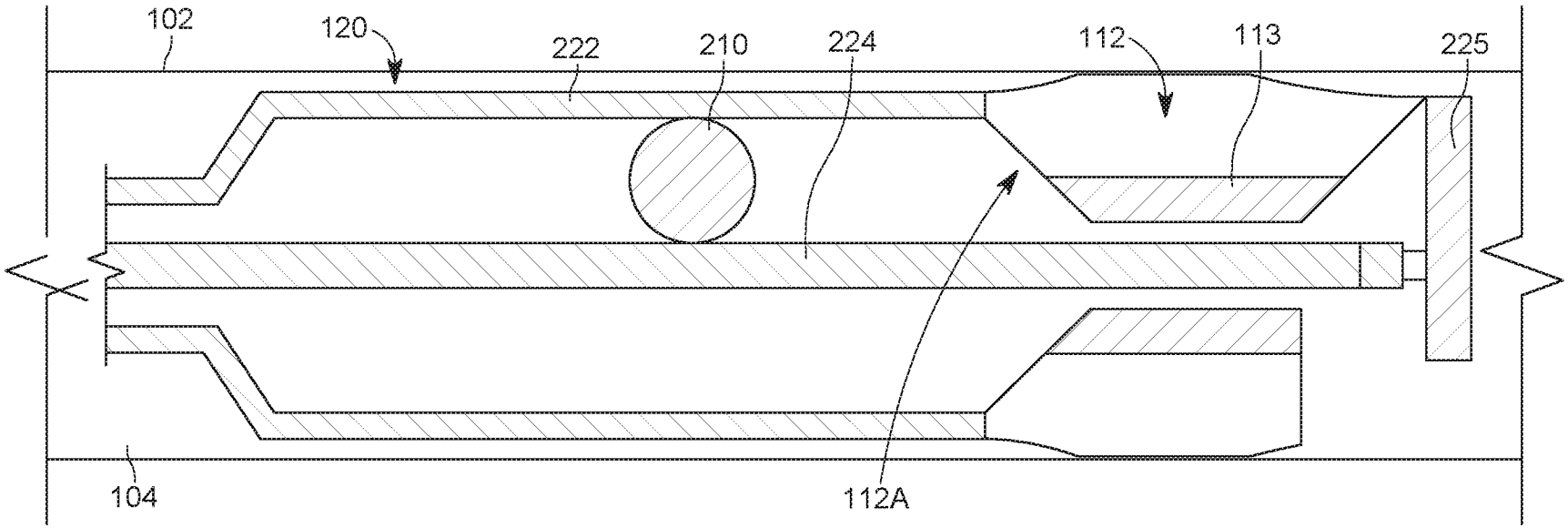
FIG. 2 (BACKGROUND ART)
FIG. 2 illustrates a setting tool that stores a single restriction element for plugging a plug.

A large-bore plug that may be used with the novel two-part restriction element discussed above is first introduced. Note that because the plug 112 in FIG. 2 has an internal mandrel 113 for supporting its various components, that plug is by definition not a large-bore plug. In other words, any plug that has an internal mandrel is not a large-bore plug because the internal mandrel takes too much space to implement a large bore.

Figure 3:
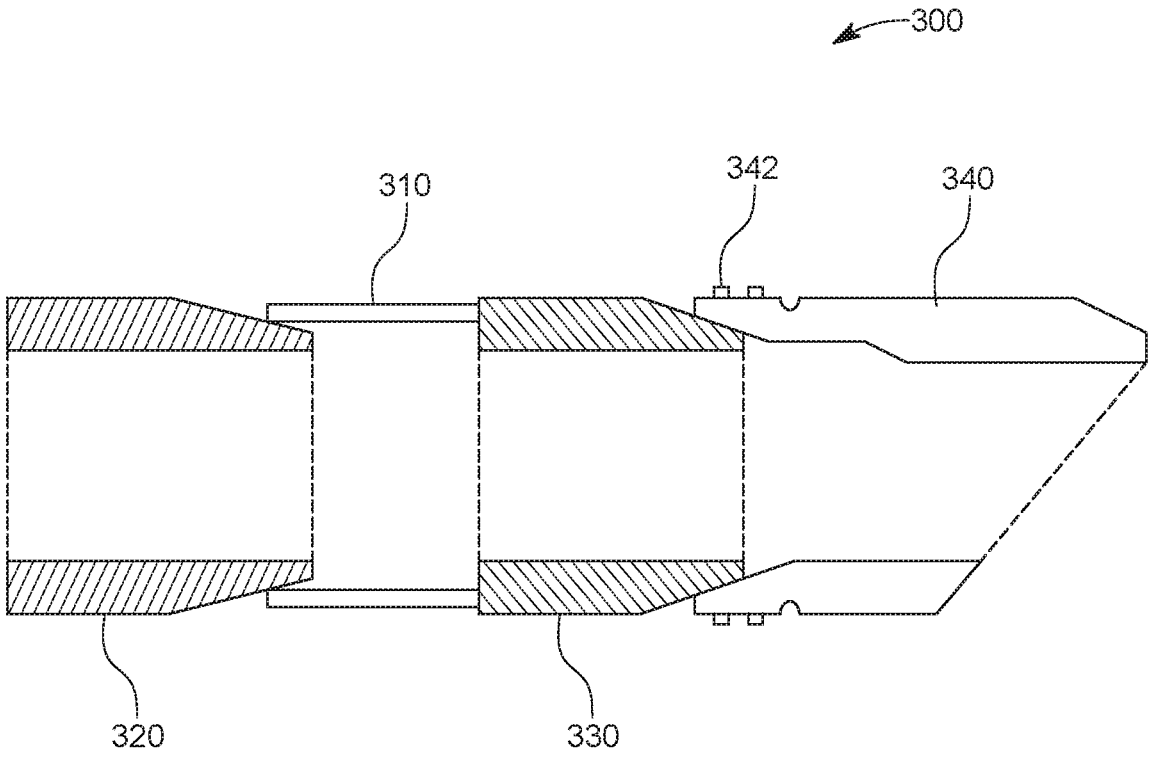
FIG. 3 illustrates a large-bore plug that has no interior mandrel.

As shown in FIG. 3, a large-bore plug 300 is designed to have no mandrel for holding its various elements. The large-bore plug 300 (from herein called "the plug"), in its minimal configuration, includes a top wedge element 320 that is located upstream a sealing element 310. The terms "top" or "upstream" and "bottom" or "downstream" are used herein interchangeably, and they relate to the head and toe, respectively, of the well in which the plug is placed. A central body 330 is placed downstream the sealing element 310, in direct contact with the sealing element. This element, as discussed later, has at least two purposes: first to prevent the sealing element from sliding downstream when the setting tool is actuating the plug, and second to push away outward or radially the slips 342 (to be discussed later) when the plug is set. The plug 300 also includes a shoe 340 that may be integrally formed with the slips 342. Thus, in this minimalistic configuration, the plug 300 includes four elements and no mandrel. The components of the plug 300 have a simply geometry, which makes these elements good candidates for a direct molding manufacturing process.

The sealing element may be made not only from a plastically deformable material, but also from a material that is degradable when interacting with one or more of the fluids present in a well. For example, the sealing element may include an aluminum- or magnesium-based material, which is plastically deformable and degradable at the same time. In one application, the sealing element may include dissolvable plastics and/or dissolvable and degradable materials. In one application, the sealing element includes an elastic material. In still another application, the sealing element includes an elastic material and a plastically deformable material. Other components may be added to the plug 300, as for example, top slips located between the sealing element 310 and the top wedge element 320.

Figure 4:
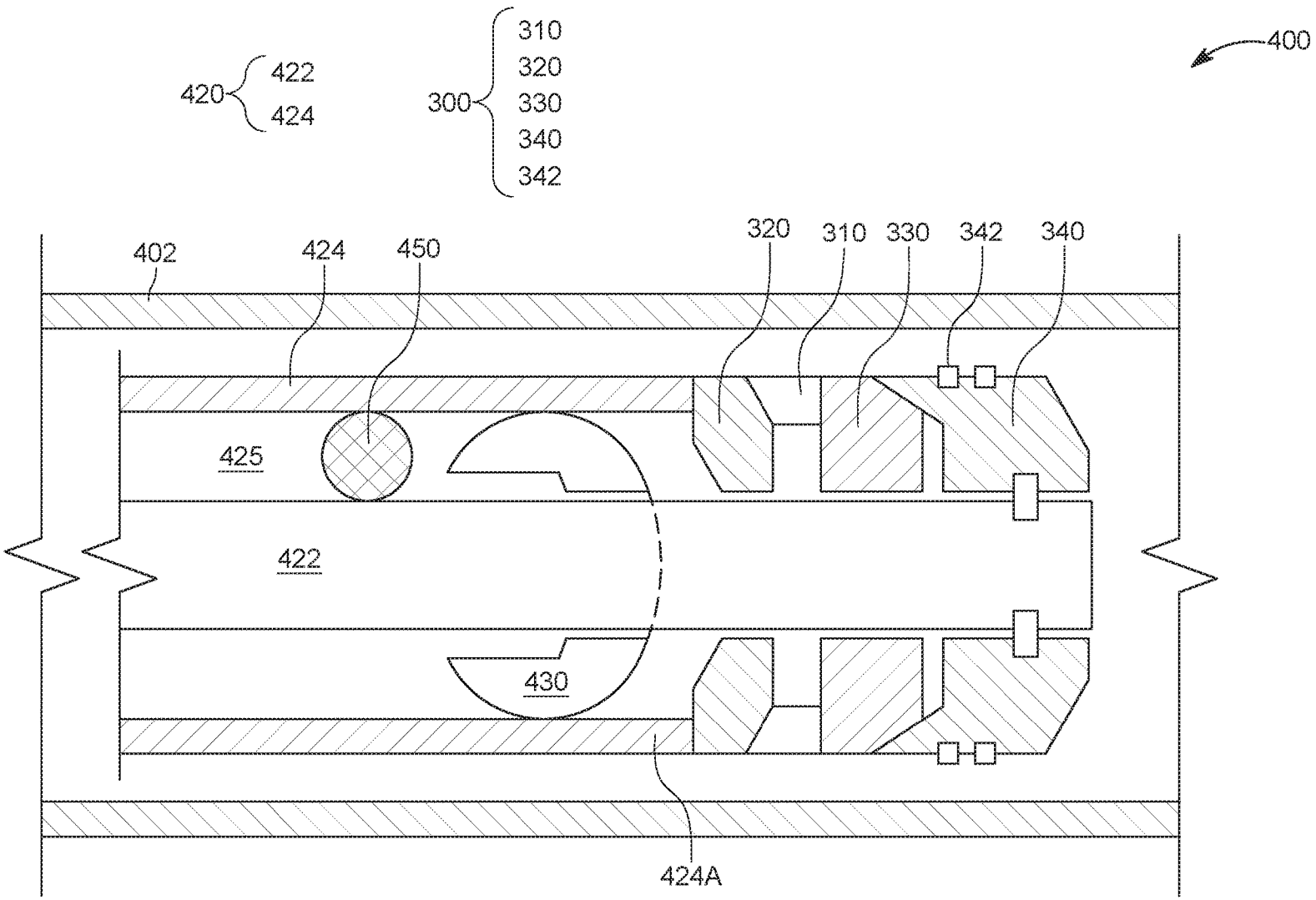
FIG. 4 illustrates a system having a setting tool, a two-part restriction element, and a plug.

FIG. 4 illustrates a system 400 having a plug 300 that is located in a horizontal portion of a casing 402. Plug 300 may have a different configuration than the one shown in FIG. 4. Also shown in FIG. 4 is the setting tool 420 having a mandrel 422 and a reactionary sleeve 424, the two elements defining an internal chamber 425. A first restriction element 430 is shown disposed around the mandrel 422 and a second restriction element 450 is shown being positioned inside the setting tool, between the mandrel 422 and the reactionary sleeve 424. Both the first and the second restriction elements are located fully within the internal chamber 425. Although both the first and second restriction elements are shown being shaped as balls, this and other embodiments discussed herein would also work with other shapes, for example, cylinder, dart, oval, etc. The first and second restriction elements may be made of any material, such as ceramic, composite, metal, etc. In one application, the restriction elements are made of a degradable material, i.e., a material that degrades when in contact with the well fluid or when exposed to a certain temperature. The first and second restriction elements may be made to have various holes drilled into their body to promote a contact between the fluid well and the material. These holes are not made throughout the entire body of the restriction elements.

Figure 5A:
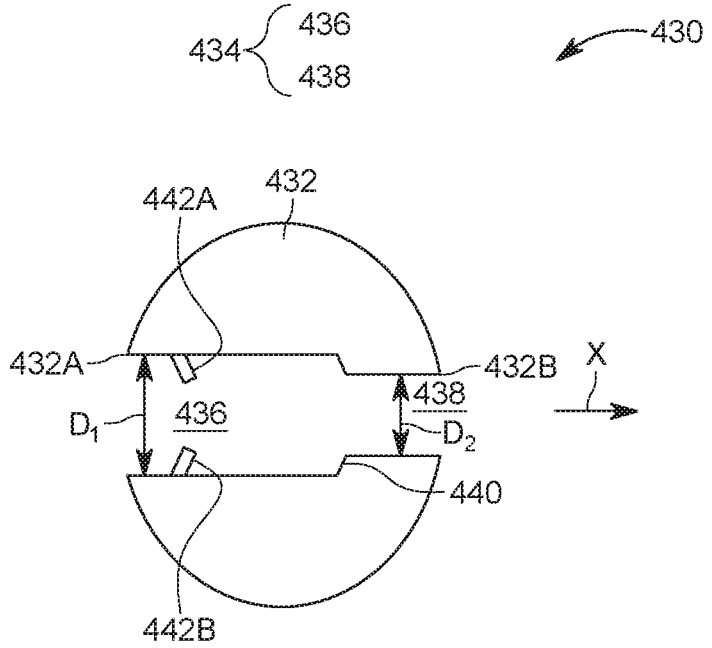
FIGS. 5A and 5B illustrate the first restriction element and FIG. 5C illustrates the second restriction element positioned inside the first restriction element.
Figure 5B:
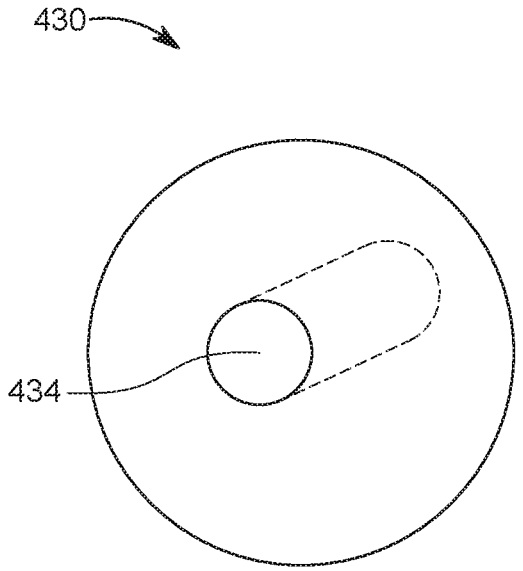

The first restriction element 430 is shown in more detail in FIGS. 5A and 5B. FIG. 5A is a cross-section of the first restriction element and shows the body 432 having a passage 434 that extends from one external part 432A of the body to an opposite external part 432B of the body. The passage 434 has a first part 436 and a second part 438. The diameter D1 of the first part 436 is larger than the diameter D2 of the second part 438. A shoulder 440 is formed between the first part 436 and the second part 438. The shoulder 440 is designed to stop an advancement of the second restriction element 450 when entering inside the passage 434. Thus, an external diameter of the second restriction element 450 is smaller than D1, so that the second restriction element can advance along the first part 436 of the passage 434. However, the external diameter of the second restriction element 450 is larger than D2, so that the second restriction element cannot advance along the second part 438 of the passage 434. FIG. 5B shows an overall view of the first restriction element, with the passage 434 being partially visible.

Figure 5C:
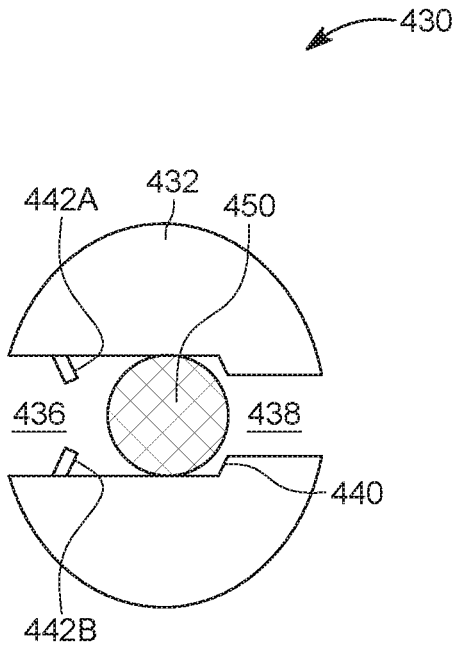

A flexible member 442A and 442B (two are shown in the figure but one can be also used) is provided inside the first part 436 of the passage 434. This flexible member is designed to bend along the X direction when the second restriction element passes by, but not in the opposite of the X direction, so that the second restriction element is trapped inside the first part of the passage 434. FIG. 5C shows the second restriction element 450 being trapped inside the first restriction element, between the shoulder 440 and the flexible member 442A and 4426. The flexible member may be a piece of steel or other bendable material.

Figure 6:
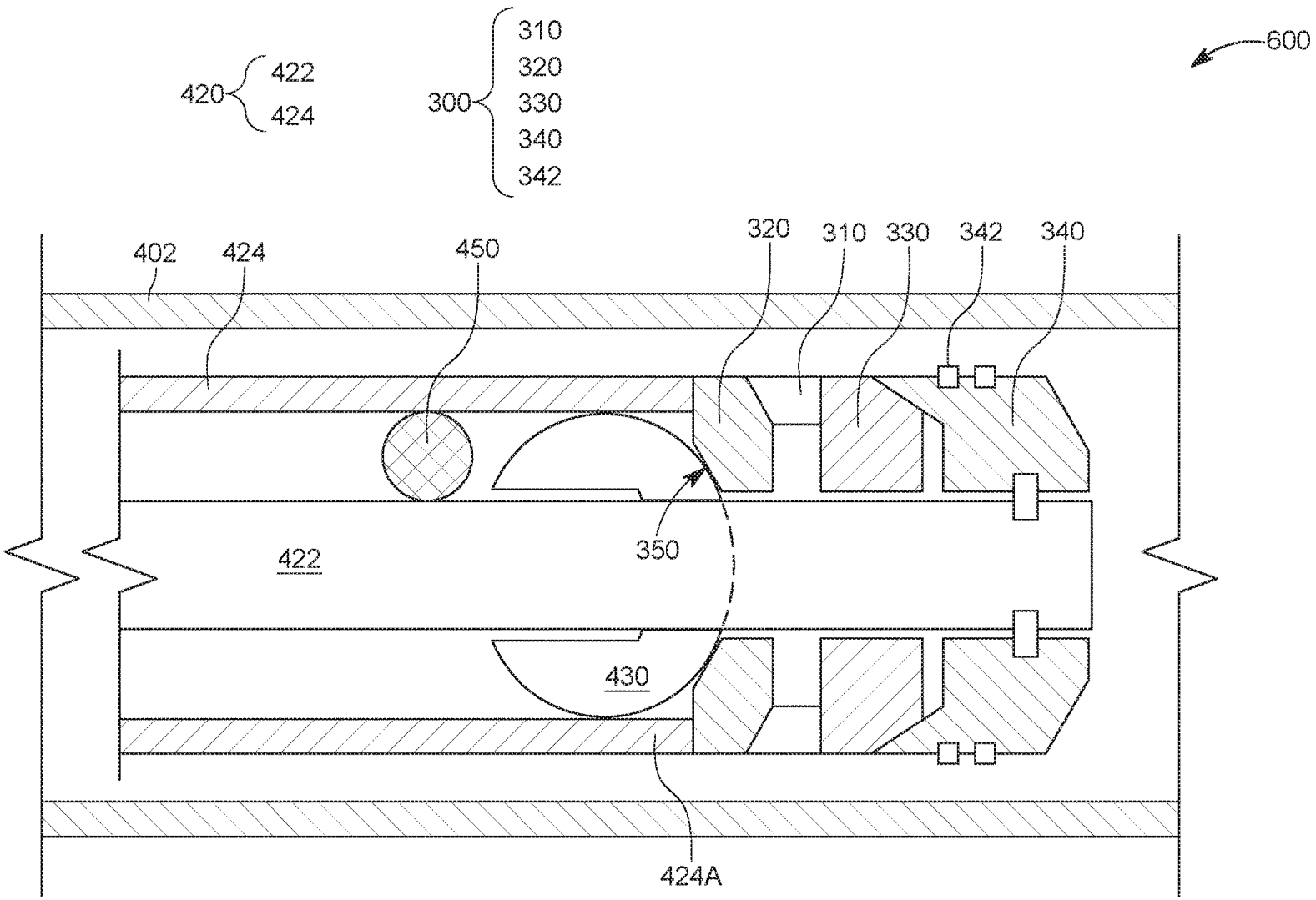
FIG. 6 shows a system in which the first restriction element is attached to the large-bore plug.

Returning to FIG. 4, it shows that the first restriction element 430 is initially located between a distal end 424A of the sleeve 424 and the second restriction element 450. In another embodiment, as illustrated in FIG. 6, the system 600 has the first restriction element 430 being lightly attached to the plug 300. Plug 300 is shown having a seat 350 formed in the top wedge 320. The profile of the seat 350 is formed to interact with the first restriction element 430 in such a way to impede all fluid flow past this intersection point. The term "lightly attached" in this context means that the first restriction element is attached to the seat 350 by any means, enough that the first restriction element comes off the mandrel 422 when the setting tool is pulled apart from the plug 300. In one application, the first restriction element is glued to the plug before the setting sleeve is attached to the plug. In another embodiment, the first restriction element is attached with a cable or rope to the plug 300.

Figure 7:
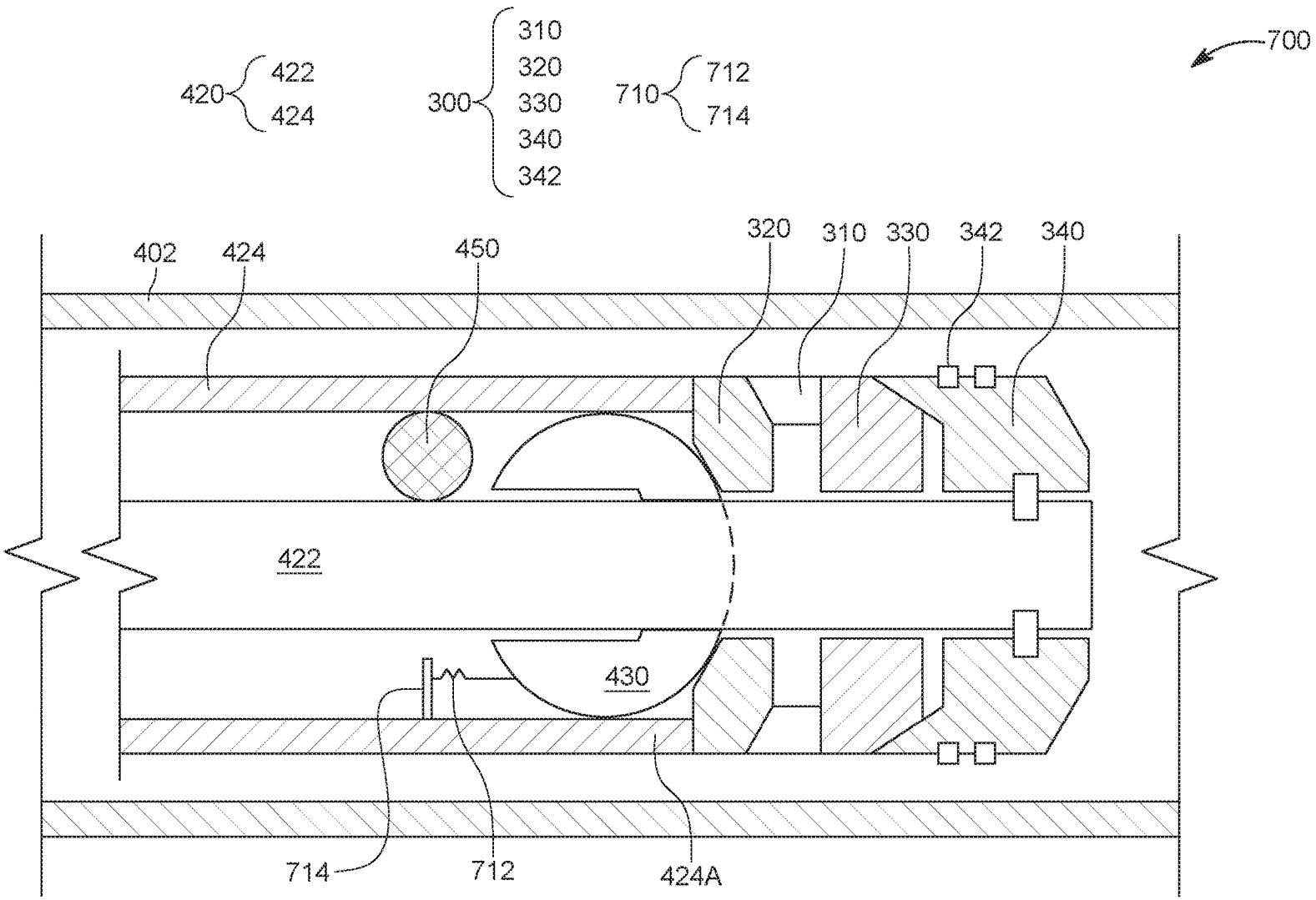
FIG. 7 shows a system in which the first restriction element is biased with a biasing mechanism to exit the setting tool.

In another embodiment, as illustrated in FIG. 7, the system 700 has a biasing mechanism 710 for forcing the first restriction element 430 off the mandrel 422 of the setting tool 420 when the setting tool is retrieved from the plug. The biasing mechanism 710 may include a bracket 714 that is fixedly attached to the reactionary sleeve 424 and a spring type device 712 (e.g., a spring) that applies a force to the first restriction element, toward the plug. The spring type device 712 may be already tensioned when the first restriction element is inside the reactionary sleeve, and what prevents the first restriction element from moving outside the setting tool in the presence of the plug. Other mechanisms may be used for removing the first restriction element from the mandrel when the mandrel is retrieved from inside the plug. In one embodiment, the first restriction element comes off by itself from around the mandrel 422 when the setting tool has been retrieved from the plug, either due to the inclination of the casing 402, or due to the fluid flow inside the well.

Figure 8:
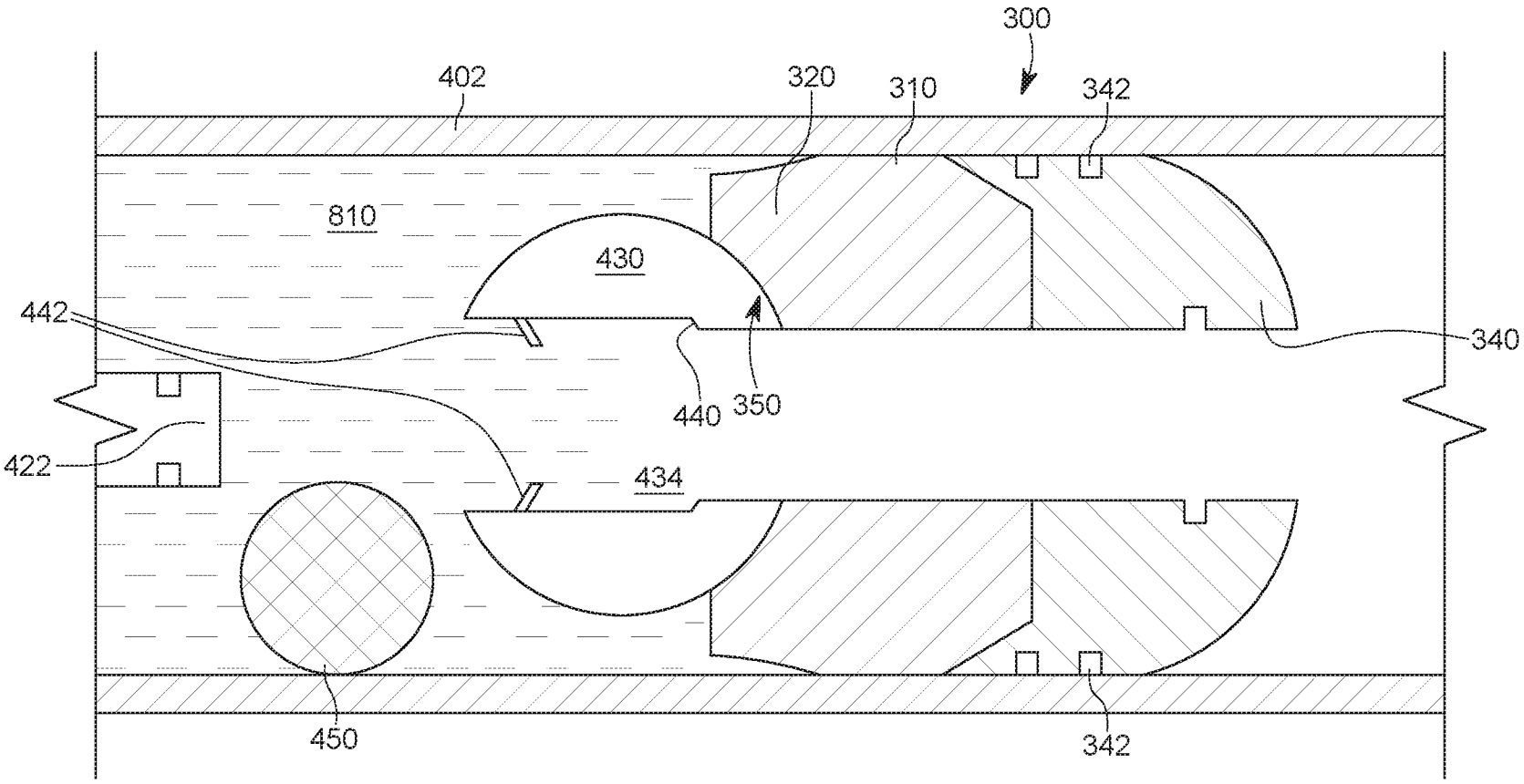
FIG. 8 shows the first restriction element being seated in the large-bore plug.

FIG. 8 illustrates an embodiment in which the setting tool has set the plug 300 (note that the sealing element 310 presses against the casing 402) and the mandrel 422 and the reactionary sleeve (not visible) have been pulled away from the plug 300. The first restriction element 430 is shown seated in its seat 350 of the top wedge 320, and the second restriction element 450 is outside the setting tool, next to the first restriction element 430. However, at this time, the second restriction element 450 has not been paired with the first restriction element 430.

Figure 1:
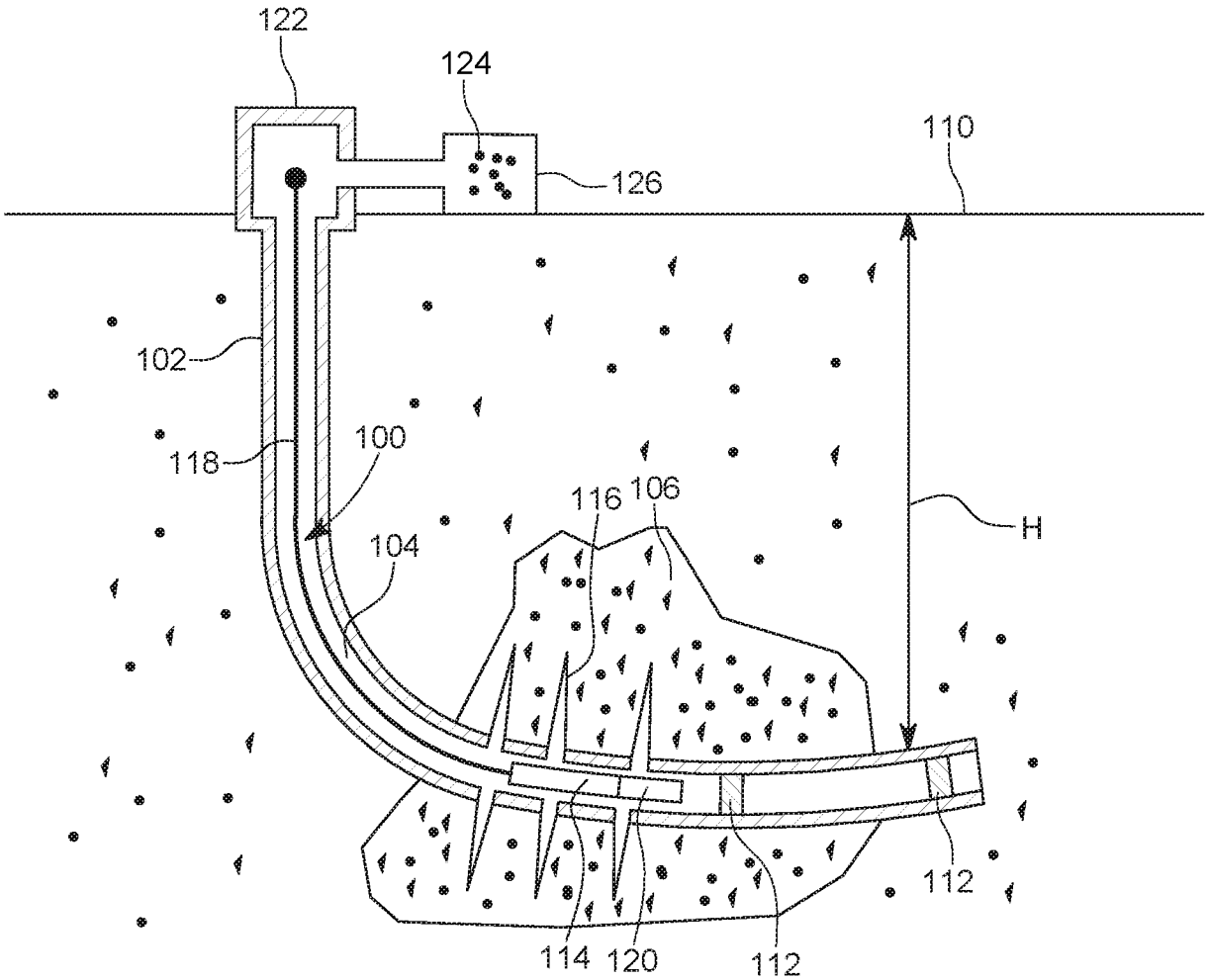
FIG. 1 (BACKGROUND ART)
FIG. 1 illustrates a well and associated equipment for well completion operations.
Figure 9:
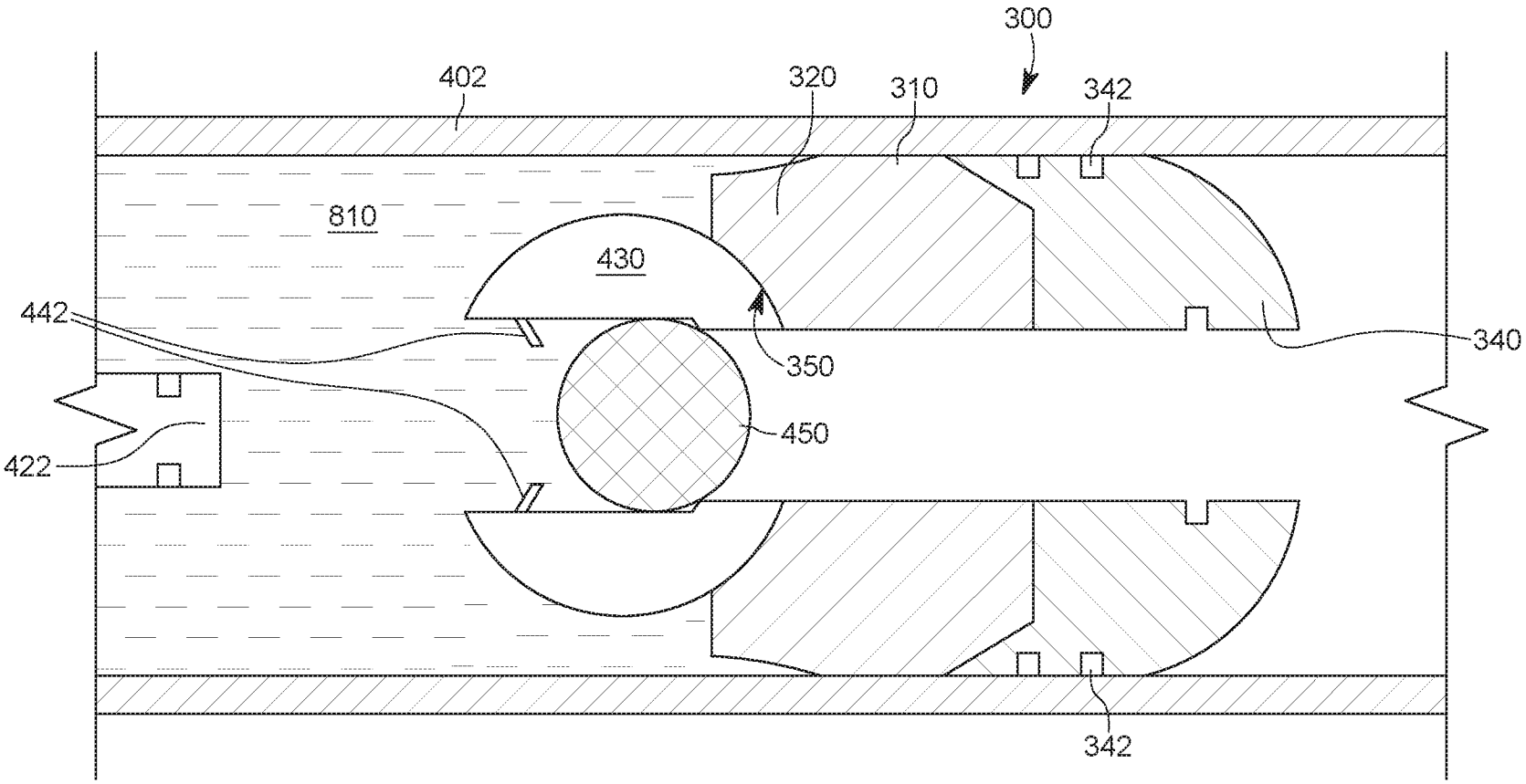
FIG. 9 shows the second restriction element being seated within the first restriction element.

Next, the pressure of the well fluid is increased, for example, with the pump 126 shown in FIG. 1, so that a flow of the well fluid 810 is achieved. The flow would push the second restriction element 450 toward and into the passage 434 of the first restriction element 430, as illustrated in FIG. 9. Also note that the second restriction element 450 has passed the flexible member 442 so that the second restriction element is now trapped inside the first restriction element. At this time, the plug 300 has completely sealed the casing, in the sense that the fluid well 810 cannot pass from upstream the plug to a portion downstream of the plug. Note that the plugging of the casing has been achieved with a minimum of fluid flow as the two-part restriction element was delivered to the plug by the setting tool, which is located next to the plug.

However, if it is desired to open the plug and allow fluid communication through the plug, then a flow back operation may be performed. The flow back means that a pressure upstream the plug is reduced relative to a pressure downstream the plug. For example, the upstream pressure may be reduced with the help of the pump 126. When the pressure downstream the plug is larger than the pressure upstream the plug, the fluid flow reverses, and the fluid is now moving toward the head of the well, as illustrated by arrow 1010 in FIG. 10. Because of the new direction of the well fluid 810, the first restriction element 430 detaches from the plug 300 and moves upstream. The second restriction element 450 is prevented by the flexible member 442 to exit the first restriction element 430, and thus, the two part restriction element 430/450 moves as a whole in the upstream direction.

Figure 11:
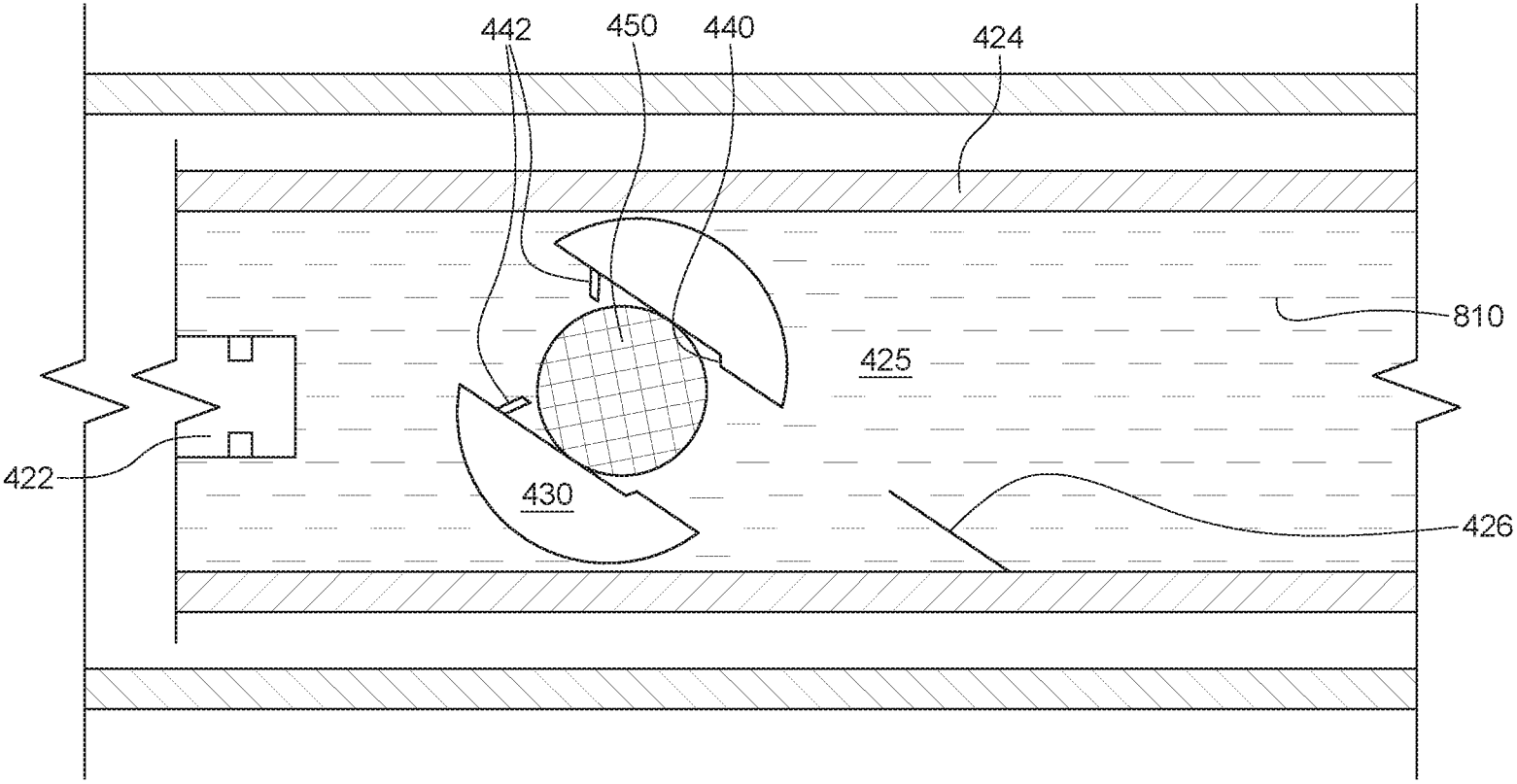
FIG. 11 shows the first and second restriction elements being trapped inside the setting tool.

Further, if it is desired to retrieve the first and second restriction elements and bring them to the surface, the setting tool may be adapted to perform this task. FIG. 11 shows the first and second restriction elements 430 and 450 inside the chamber 425 defined inside the reactionary sleeve 424. This happens because the flow back of the well fluid 810 has pushed the two restriction elements in an upstream direction into the setting tool. In addition, this is possible because (1) the second restriction element 450 is trapped inside the first restriction element 430, between the flexible member 442 and the shoulder 440, and (2) the mandrel 422 has been withdrawn at an end of the reactionary sleeve 424. To prevent the first and second restriction elements from falling off the setting tool when the setting tool is brought to the surface, a flexible member 426 is located inside the chamber 425, attached to the reactionary sleeve 424. In this way, once the first restriction element 430 passes the flexible member 426, which bends to allow the passage of the restriction element, the first restriction element becomes trapped inside the chamber 425, between the mandrel 422 and the flexible member 426. In this way, the first and second restriction elements are confined inside the chamber 425 and cannot fall out of the setting tool when the setting tool is brought to the surface.

Figure 12:
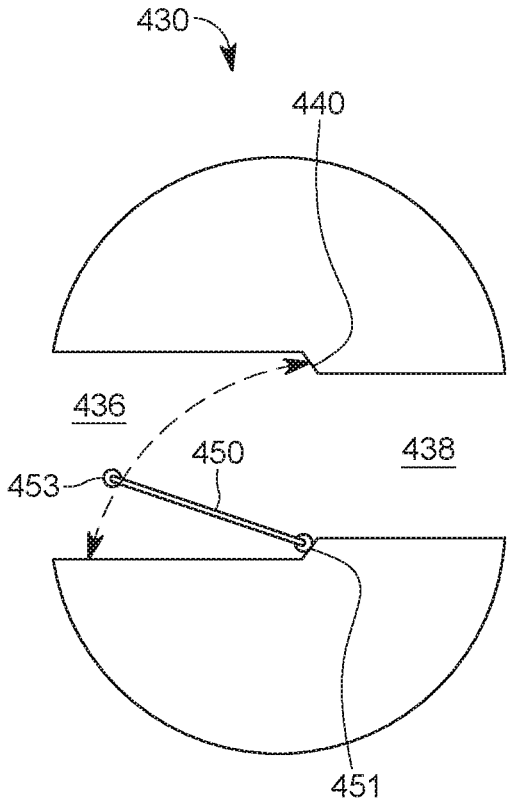
FIG. 12 shows the second restriction element being replaced with a flapper valve located inside the first restriction element.

Instead of using the second restriction element 450 to block the passage 434 formed through the first restriction element 430, in one embodiment, it is possible to use a flapper valve 450, as shown in FIG. 12. The flapper valve 450 is configured to close the passage 434 when the upstream pressure is higher than the downstream pressure. The flapper valve 450 would open again when the downstream pressure becomes larger than the upstream pressure. The flapper valve 450 has a hinge 451 that is attached to the inside of the first restriction element 430 and a free end 453 that can move toward the shoulder 440, to close the passage 434.

The two-part reactionary element 430/450 discussed in the previous embodiments has the advantage that the presence of the mandrel inside the setting tool does not limit the size of the restriction element. This is so because the first restriction element is disposed around the mandrel, and thus, only the inner diameter of the reactionary sleeve limits the size of the first restriction element. However, this is not an impediment as the size of the reactionary element matches the size of the large-bore plug. The passage formed inside the first restriction element for accommodating the mandrel of the setting tool is sealed with a second restriction element, which is located inside the setting tool, between the mandrel and the reactionary sleeve.

Due to the location of the first and second restrictive elements, in the proximity of the plug, after the setting tool is retrieved from the plug, the amount of time and the amount of fluid well that needs to be pumped to close the plug is greatly reduced comparative to the traditional method. Note that for a large-bore plug, traditionally the setting tool has to be taken out of the well (which is time consuming) and then the restriction element has to be pumped from the head of the well (which is not only time consuming but also requires a large amount of well fluid to be pumped). Thus, the two part restriction element discussed above saves time and fluid during the sealing process.

Figure 10:
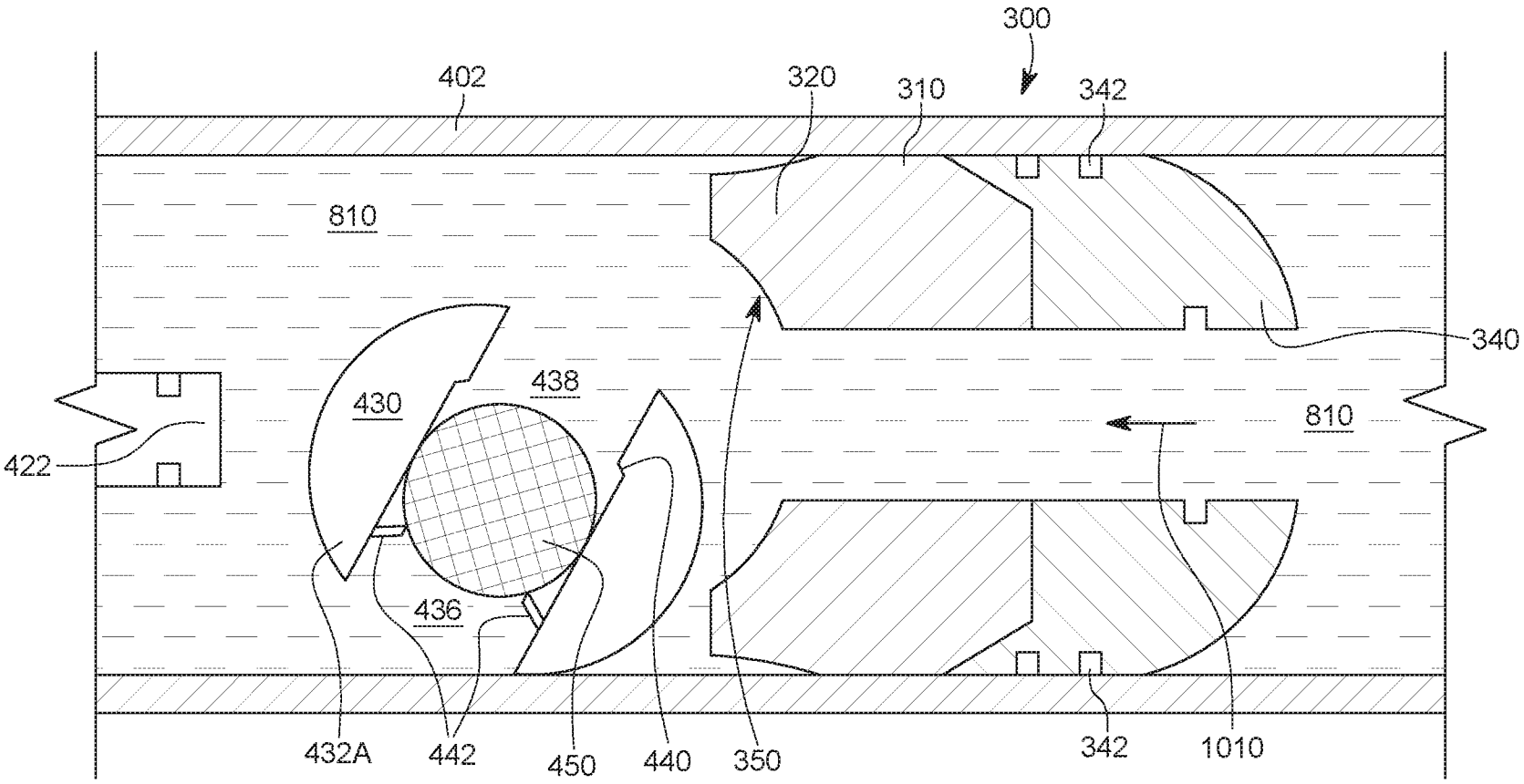
FIG. 10 shows the first restriction element trapped inside the second restriction element and the two restriction elements moving away from the large-bore plug.
Figure 13:
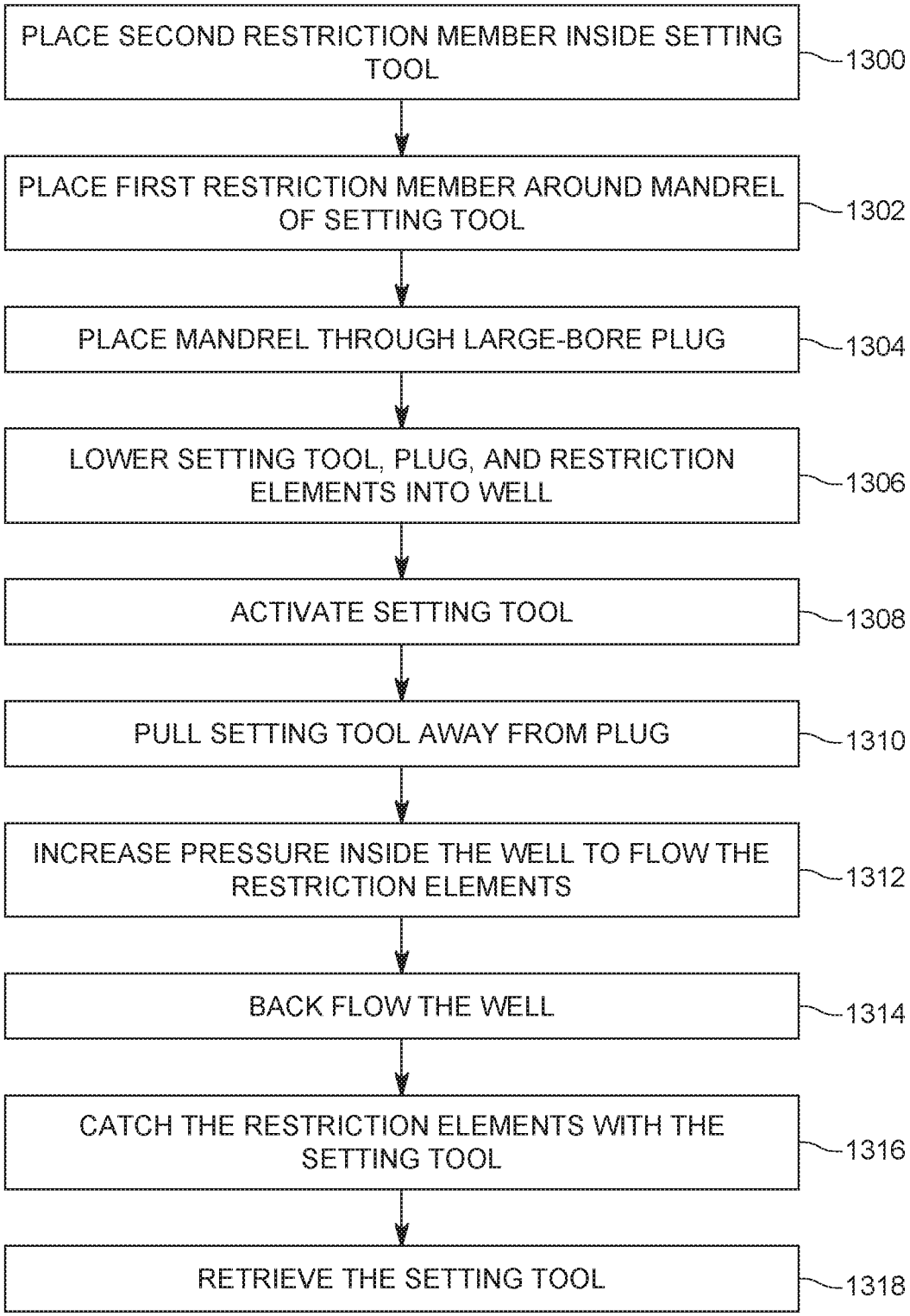
FIG. 13 is a flowchart illustrating a method for deploying, setting, and plugging the large-bore plug.
Figure 14:
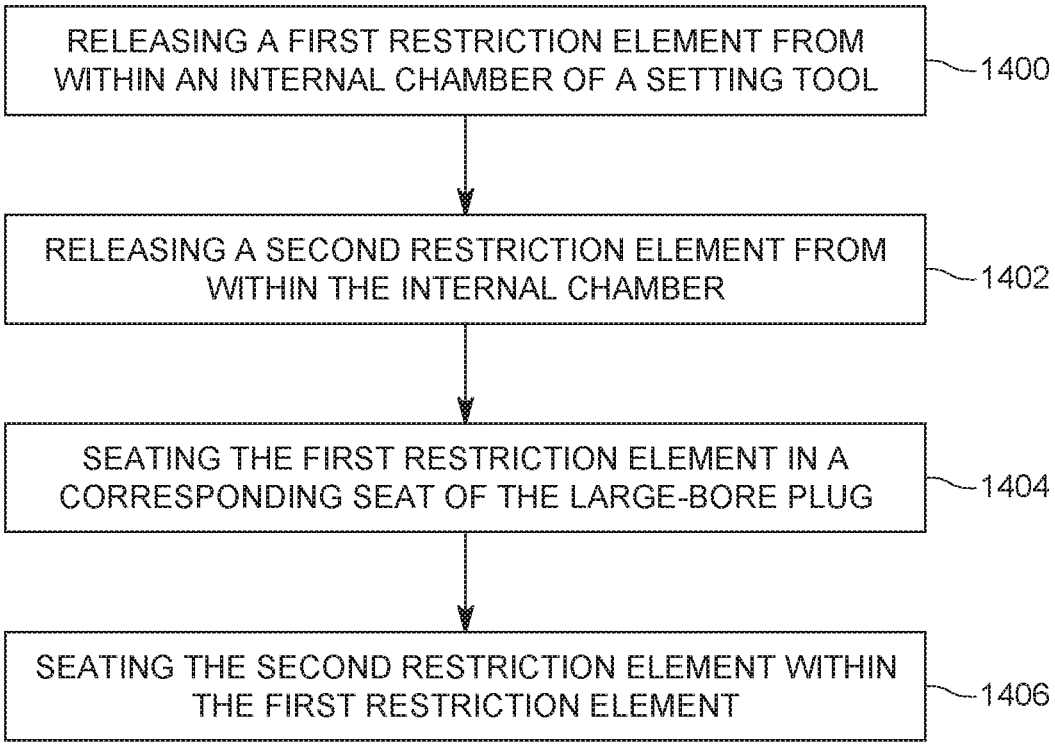
FIG. 14 is a flowchart of a method for placing the first and second restriction elements on a large-bore plug.

A method for lowering and setting a large-bore plug is now discussed with regard to FIG. 13. In step 1300, the second restriction member 450 (or a small restriction element) is placed inside the setting tool 420, between the mandrel 422 and the reactionary sleeve 424. In step 1302, the first restriction member 430 (or a large restriction element) is placed around the mandrel 422, so that the second restriction member 450 is blocked inside a chamber 425 of the setting tool. In step 1304, the mandrel 422 is extended through the large-bore plug 300 and also connected to a shoe 340 of the plug. In step 1306, the system 400 that includes the setting tool 420, the first and second restrictions members 430 and 450, and the large-bore plug 300 are lowered into the casing 402, as indicated in FIG. 4. In step 1308, the setting tool is activated so that the mandrel 422 is pulled, along a longitudinal direction of the well, toward the reactionary sleeve 424 to compress the plug 300, which will result in setting the plug. The mandrel 422 would break away from the plug 300, thus setting the plug. In step 1310, the entire setting tool is pulled away from the plug 300, as illustrated in FIG. 8, which results in the first and second restriction elements being released into the well. The pressure of the well fluid is increased in step 1312, which will make the first restriction element 430 to sit into a corresponding seat of the plug, and the second restriction element 450 to enter inside the first restriction element, and to block a through passage formed in the first restriction element, as illustrated in FIG. 9. In step 1314, a back flow is established in the well by reducing the pressure of the well fluid upstream the plug, so that the downstream pressure is higher. This difference in pressure would determine the well fluid to flow toward the head of the well, which would unseat the first restriction element from its location, next to the plug. Because the second restriction element is trapped inside the first restriction element due to a flexible member 442, as illustrated in FIG. 10, both the first and second restriction elements move in the upstream direction, thus reestablishing the fluid communication across the large-bore plug 300. In step 1316, the upstream moving well fluid forces the first restriction element 430 into the chamber 425 of the setting tool 420, as illustrated in FIG. 11, and thus the setting tool traps both the first and second restriction elements inside the restriction sleeve. In step 1318 the setting tool is retrieved to the surface, together with the first and second restriction elements.

In still another embodiment, there is a method for plugging a well with a large-bore plug that includes a step 1400 of releasing a first restriction element from within an internal chamber of a setting tool, a step 1402 of releasing a second restriction element from within the internal chamber, a step 1404 of seating the first restriction element in a corresponding seat of the large-bore plug, and a step 1406 of seating the second restriction element within the first restriction element. The method may also include a step of setting up the large-bore plug with the setting plug, before seating the first and second restriction elements. In one application, the method may also include a step of placing a mandrel of the setting tool through a passage of the first restriction element. Further, the method may include a step of placing the second restriction element inside the setting tool, between the mandrel and a reactionary sleeve, and/or a step of placing the mandrel through the large-bore plug. The method may also include a step of activating the setting tool to set up the large-bore plug and/or a step of pulling the setting tool apart from the large-bore plug. Further, the method may also include a step of increasing a pressure inside the well to seat the first and second restriction elements and/or a step of flowing back the well to remove the first restriction element from the large-bore plug, wherein the second restriction element is trapped inside a passage of the first restriction element. In another application, the method may include a step of trapping the first and second restriction elements inside the setting tool; and a step of retrieving the setting tool and the first and second restriction elements to the surface.

The disclosed embodiments provide methods and systems for providing a large-bore plug with a corresponding large restriction element without taking out the setting tool from the well after setting up the plug. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A downhole isolation system for sealing a well with a large-bore plug, the downhole isolation system comprising:

a setting tool having an internal chamber defined by a reactionary sleeve and a mandrel of the setting tool;

a first restriction element entirely placed within the internal chamber of the setting tool; and a second restriction element entirely placed within the internal chamber, separate from the first restriction element, wherein the first restriction element includes a passage that extends throughout the first restriction element, and wherein the second restriction element fits inside a first part of the passage.

2. The system of claim 1, wherein an external diameter of the first restriction element is larger than an external diameter of the second restriction element.

3. The system of claim 1, wherein the passage has the first part and a second part, the second part having a smaller diameter than the first part, and the second restriction element fits inside the first part, but not the second part.

4. The system of claim 1, wherein the first restriction element comprises a flexible element located inside the passage and configured to allow the second restriction element to move one way only along the passage.

5. The system of claim 1, further comprising: a biasing mechanism that exerts a force on the first restriction element.

6. The system of claim 1, further comprising:

a large-bore plug attached to the setting tool.

7. The system of claim 1, wherein the mandrel of the setting tool extends through a passage formed throughout the first restriction element and connects to the large-bore plug.

8. The system of claim 7, wherein the second restriction element is placed between the mandrel and the reactionary sleeve.

9. A downhole isolation system for sealing a well, the downhole isolation system comprising:

a large-bore plug having a seat at an upstream end, wherein the large-bore plug does not include a mandrel so that a diameter of an inner bore of the large-bore plug is not limited by the mandrel;

a first restriction element configured to sit in the seat of the large-bore plug; and a second restriction element configured to fit inside the first restriction element, wherein the first restriction element includes a passage that extends throughout the first restriction element, and wherein the second restriction element fits inside a first part of the passage.

10. The system of claim 9, wherein an external diameter of the first restriction element is larger than an external diameter of the second restriction element.

11. The system of claim 9, wherein the passage has the first part and a second part, the second part having a smaller diameter than the first part, and the second restriction element fits inside the first part, but not the second part.

12. The system of claim 9, wherein the first restriction element comprises a flexible element located inside the passage and configured to allow the second restriction element to move one way only along the passage.

13. The system of claim 9, further comprising:

a setting tool having an internal chamber, wherein the first and second restriction elements fit inside the internal chamber.

14. The system of claim 13, wherein the setting tool further comprises: a biasing mechanism that exerts a force on the first restriction element.

15. The system of claim 13, wherein the setting tool includes a mandrel and a reactionary sleeve that define the internal chamber.

16. The system of claim 15, wherein the mandrel of the setting tool extends through a passage formed throughout the first restriction element and connects to the large-bore plug.

17. The system of claim 16, wherein the second restriction element is placed between the mandrel and the reactionary sleeve.

18. A method for plugging a well with a large-bore plug, the method comprising:

releasing a first restriction element from within an internal chamber of a setting tool;

releasing a second restriction element from within the internal chamber;

seating the first restriction element in a corresponding seat of the large-bore plug, wherein the large-bore plug does not include a mandrel so that a diameter of an inner bore of the large-bore plug is not limited by the mandrel; and seating the second restriction element within the first restriction element, wherein the first restriction element includes a passage that extends throughout the first restriction element, and wherein the second restriction element fits inside a first part of the passage.

19. The method of claim 18, further comprising:

setting up the large-bore plug with the setting plug, before seating the first and second restriction elements.

20. The method of claim 18, further comprising:

placing a mandrel of the setting tool through a passage of the first restriction element.

21. The method of claim 20, further comprising:

placing the second restriction element inside the setting tool, between the mandrel and a reactionary sleeve.

22. The method of claim 21, further comprising:

placing the mandrel through the large-bore plug.

23. The method of claim 22, further comprising:

activating the setting tool to set up the large-bore plug.

24. The method of claim 23, further comprising:

pulling the setting tool apart from the large-bore plug.

25. The method of claim 24, further comprising:

increasing a pressure inside the well to seat the first and second restriction elements.

26. The method of claim 18, further comprising:

flowing back the well to remove the first restriction element from the large-bore plug, wherein the second restriction element is trapped inside a passage of the first restriction element.

27. The method of claim 26, further comprising:

trapping the first and second restriction elements inside the setting tool; and retrieving the setting tool and the first and second restriction elements to the surface.

* * * * *